US005479754A

United States Patent [19]

Pelvilain et al.

[11] Patent Number: 5,479,754

[45] Date of Patent: Jan. 2, 1996

[54] METHOD AND APPARATUS FOR INSTALLING AN ELEVATOR SHAFT DOOR

[75] Inventors: Jean C. Pelvilain, Ponthierry, France; Klaus Betzin, Berlin, Germany

[73] Assignee: Inventio AG, Hergiswil, Switzerland

[21] Appl. No.: 181,347

[22] Filed: Jan. 14, 1994

[30] Foreign Application Priority Data

Jan. 14, 1993 [EP] European Pat. Off. ..... 93100430

[51] Int. Cl.[6] ..... E04B 1/00

[52] U.S. Cl. ..... 52/745.16; 52/30; 52/204.1; 52/213; 187/408

[58] Field of Search ..... 52/30, 204.1, 211, 52/213, 215, 745.15, 745.16; 187/401, 408

[56] References Cited

U.S. PATENT DOCUMENTS

| | | | |
|---|---|---|---|
| 3,601,938 | 8/1971 | Loomis | 52/30 X |
| 3,741,351 | 6/1973 | Suozzo . | |
| 3,771,268 | 11/1973 | Loomis . | |
| 3,984,952 | 10/1976 | Loomis . | |
| 4,249,640 | 2/1981 | Darwent et al. | 187/401 |
| 4,819,403 | 4/1989 | Penicaut et al. | 52/745.15 |
| 5,014,822 | 5/1991 | Chapelain et al. | 52/30 X |
| 5,065,843 | 11/1991 | Richards | 187/408 |
| 5,241,789 | 9/1993 | Vacelet . | |

FOREIGN PATENT DOCUMENTS 0475074 3/1992 European Pat. Off. .

*Primary Examiner*—Lanna Mai
*Attorney, Agent, or Firm*—Howard & Howard

[57] ABSTRACT

A pre-assembled elevator shaft door assembly is installed in a shaft door opening equipped with a dowel plate, a carrier bracket and a pair of fastening plates. A protruding threshold carrier plate is mounted on the underside of the shaft door assembly and includes recesses which detent with a cut-out in the door carrier bracket. A pair of locking bar mechanisms are mounted at the upper corners of the door assembly for engaging locking bar pockets on the fastening plates to retain the shaft door assembly. Laterally extendable covering brackets on the door assembly are engaged by tongues on the fastening plates to bridge over the vertical air gaps. During the entire assembly time, the shaft door opening is secured by a movable barrier against the falling-in of persons.

16 Claims, 4 Drawing Sheets

Fig. 5a
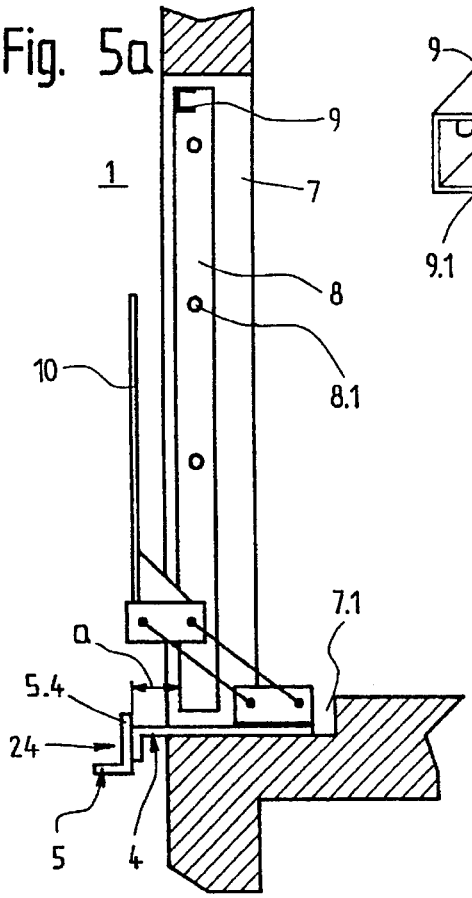
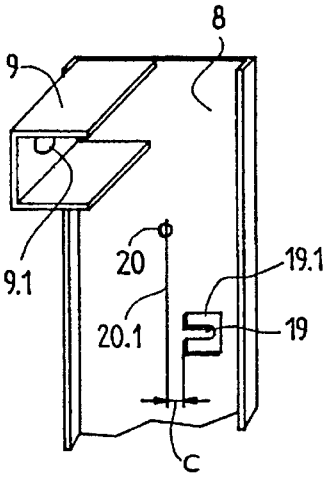
Fig. 5b
Fig. 1
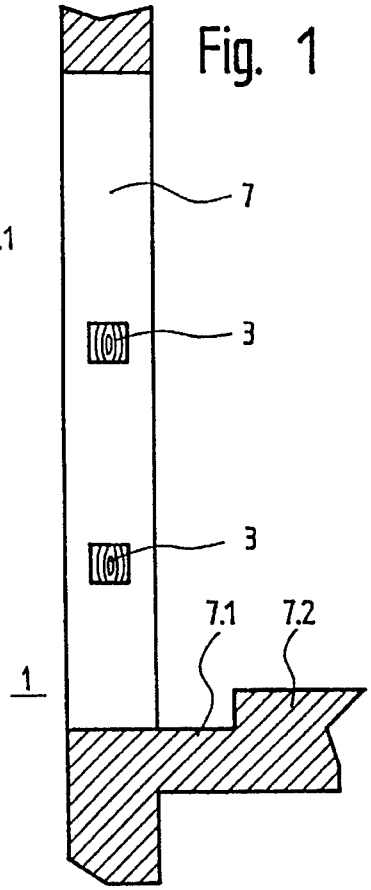
Fig. 2a
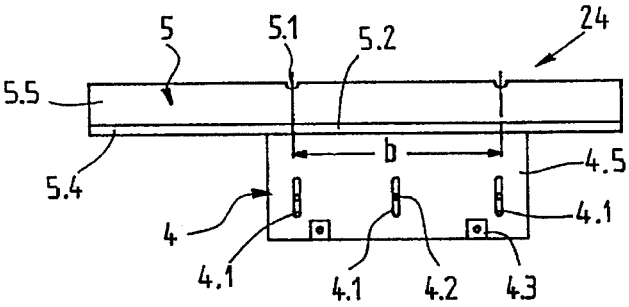
Fig. 2b
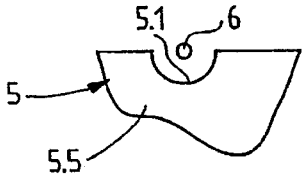
Fig. 3
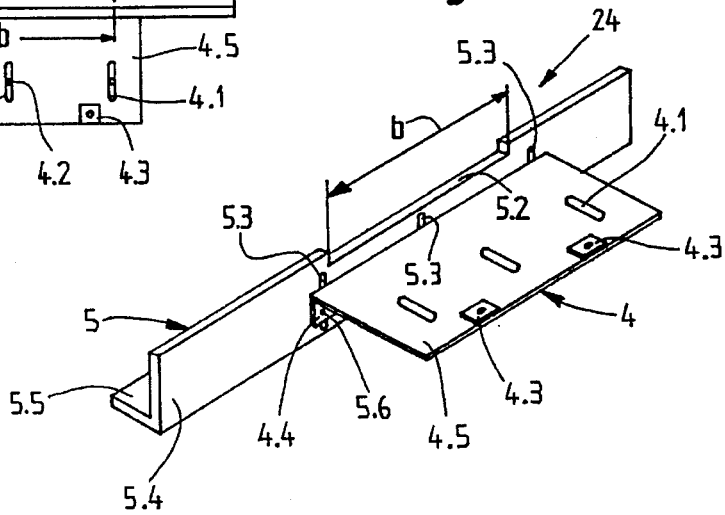

METHOD AND APPARATUS FOR INSTALLING AN ELEVATOR SHAFT DOOR

BACKGROUND OF THE INVENTION

The present invention relates generally to a method and an apparatus for installing elevator doors and, in particular, to a method and an apparatus for installing pre-assembled elevator shaft door assemblies.

The European Patent Application No. 0 475 074 describes an appropriate method for the pre-assembly of finished shaft door assemblies. Frame-shaped gauges, between which plumb wires are tensioned, are inserted at the bottom and the top of an elevator shaft. Mountings with adjusting elements in three planes are attached on the floor thresholds, whereby an orientation to the plumb wires is made possible. The shaft door assemblies are pre-assembled with all frontal elements to exact dimensions. The installation of a shaft door assembly takes place by lifting the assembly in the shaft and setting it down onto an additional mounting in the lowermost floor or suspending at an additional mounting in the uppermost floor. The installed position is determined by means of register holes and register pins. It appears that the shaft door assemblies are suspended one set onto or against the other, since their heights correspond to the floor spacing distance.

In this method, exact dimensions of the installation opening are required, because the door assemblies are installed together with the frontal cladding elements, thus with the finishing pieces. Therefore, problems with construction tolerances are possible. Furthermore, additional gauge frames must be installed in the shaft for the plumb lines. The mountings on the floors are not provided as carriers for the shaft doors. Additional carriers mounted in the lowermost or uppermost floor take over the carrying function for the shaft door assemblies. Details of the fastening of the shaft door assemblies on the floors are not illustrated and described. No devices are disclosed for protecting the shaft door opening against accidents.

SUMMARY OF THE INVENTION

The present invention concerns a method and an apparatus for the installation of an elevator shaft door. A completely pre-assembled shaft door assembly is fastened in the final position during the installation into a raw shaft door opening and then all frontal cladding parts are mounted.

The present invention is based on the task of creating an efficient method and apparatus, by which pre-assembled shaft door assemblies can be positioned individually at the floors by means of simple mountings and fastened in the final position, wherein no special devices or gauges are needed. Furthermore, construction tolerances in the range of a few centimeters shall be able to be bridged over. The installation shall be possible in the shell construction stage and the greatest possible safety against accident shall be assured for each working step.

The problem is solved by the present invention in that appropriately shaped carrier parts, which are aligned with a plumb line, receive the individual pre-assembled shaft door assemblies in position on the floors and these assemblies are locked and fastened by means of sliding locking bars at the upper sides of the doors. A vertical air gap at each side and an horizontal air gap at the top compensate for construction tolerances and are covered over by cladding elements. During the entire assembly operation, a barrier which does not obstruct the operations is installed in the door opening.

the method according to the present invention comprises the steps of: orienting a bracket assembly having a predetermined length door carrier cut-out formed therein at a predetermined position in a threshold recess of an elevator shaft door opening of an elevator shaft and fixing the bracket assembly to the threshold recess; orienting the door carrier cut-out to a desired height with respect to the threshold recess and fixing the door carrier cut-out at the desired height; mounting generally vertically extending fastening plates on both sides of the shaft door opening at a first predetermined distance from the door carrier cut-out; lifting a pre-assembled shaft door assembly up an elevator shaft to the shaft door opening and setting a lower end of the shaft door assembly down on the bracket assembly, the lower end of the shaft door assembly having a threshold carder plate attached thereto, the threshold carrier plate having a pair of recesses formed therein spaced apart a second predetermined distance, the second predetermined distance being less than the first predetermined distance and the recesses detenting in the door carrier cut-out; pivoting the shaft door assembly on the bracket assembly into a generally vertical position in the shaft door opening; extending laterally locking bars mounted on the shaft door assembly into locking bar pockets mounted on the fastening plates and fixing the locking bars; and bending outwardly tongues formed in the fastening plates, drawing laterally covering brackets mounted on the shaft door assembly into abutment with the fastening plates, bending the tongues over the covering brackets and fixing the covering brackets to the shaft door assembly.

The apparatus for installing an elevator door assembly in a door opening in an elevator shaft according to the present invention comprises: a bracket assembly for mounting in a generally horizontally extending threshold cut-out at an elevator shaft door opening, the bracket assembly having a dowel plate attached to a door carrier bracket, the door carrier bracket having a predetermined length door carrier cut-out formed therein, the dowel plate having means for selectively orienting the bracket assembly horizontally in the threshold cut-out and the bracket assembly having means for selectively orienting the door carrier cut-out vertically with respect to the threshold cut-out; a threshold carrier plate adapted to be attached to an elevator shaft door assembly and having a pair of recesses formed therein, the recesses being spaced apart a predetermined distance, the predetermined distance being less than the predetermined length and the recesses detenting in the door carrier cut-out; a pair of locking bar mechanisms adapted to be mounted at upper corners of the shaft door assembly and each being selectively extendable; a pair of fastening plates adapted to be mounted at opposite sides of the shaft door opening and each having a locking bar pocket for receiving an associated one of the locking bar mechanisms; and a pair of selectively displaceable covering brackets adapted to be mounted on the shaft door assembly at opposite sides thereof for abutting the fastening plates and covering air gaps between the shaft door assembly and the sides of the shaft door opening.

An advantage of the present invention is that the shaft doors in a new building construction can be pre-assembled before the actual installation of the elevator so that any desired floors can be completed and occupied. Independently of the construction tolerances, mass-produced shaft door assemblies of the same kind can be installed without special adaptations to the raw masonry shaft door openings. Thanks to the air gaps provided, which are greater than the greatest construction tolerances to be expected, and by means of universal covering and frontal elements covering the air gaps, the shaft door front surface can be mounted ready for the subsequent plastering and painting operations on the floor side of the shaft door opening.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a fragmentary cross-sectional side elevation view of an elevator shaft and associated shaft door opening in which an elevator door assembly is to be installed in accordance with the present invention;

FIG. 2*a* is top plan view of a bracket assembly in accordance with the present invention;

FIG. 2*b* is an enlarged fragmentary view of a portion of the bracket assembly shown in the FIG. 2*a* and an associated plumb line;

FIG. 3 is a perspective view of the bracket assembly shown in the FIGS. 2*a* and 2*b;*

FIG. 5*a* is a cross-sectional side elevation view of the elevator shaft door opening shown in the FIG. 1 with a fastening plate installed and blocked by a movable barrier in accordance to the present invention;

FIG. 5*b* is an enlarged fragmentary perspective view of a portion of the fastening plate shown in the FIG. 5*a;*

FIG. 8 is an enlarged fragmentary front elevation view of the shaft door assembly shown in the FIG. 6*a* installed in the shaft door opening, but not yet locked in;

DESCRIPTION OF THE PREFERRED EMBODIMENT

Figure 4A:
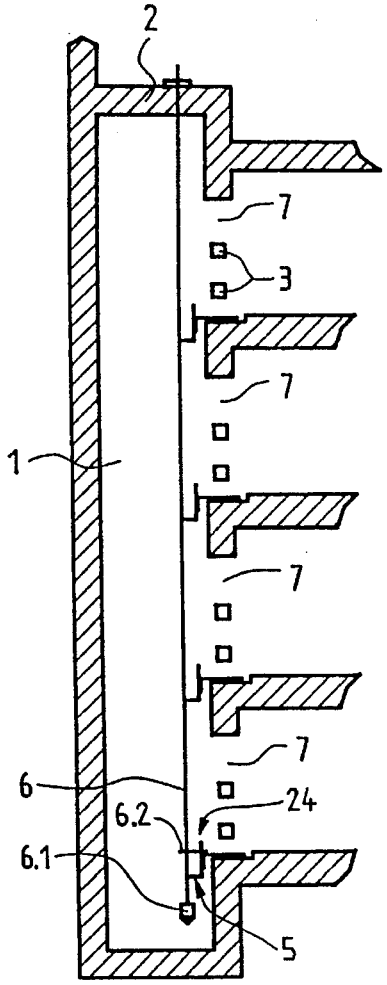
FIG. 4 is a cross-sectional side elevation view of an elevator shaft with associated door openings, each door opening having the bracket assembly shown in the FIG. 2*a* mounted therein, and the plumb line shown in the FIG. 2*b* installed.
FIG. 4*b* an enlarged fragmentary rear elevation view of a portion of the bracket assembly in the FIG. 4*a;*

There is shown in the FIG. 1 a portion of an elevator shaft 1 having a shaft door opening 7 with a fixed barrier 3 mounted therein, the barrier including a pair of generally horizontally extending beams clamped at opposite ends to the sides of the opening 7. A floor 7.2 extends from the opening 7 and has a threshold cut-out 7.1 formed therein at the shaft opening.

A bracket assembly 24 shown in the FIGS. 2*a* and 3 includes a metal dowel plate 4 attached to a door carrier bracket 5. The dowel plate 4 is bent in a generally L-shape having a shorter length, generally vertically downwardly extending leg 4.4 and a longer length, generally horizontally forwardly extending leg 4.5. The longer leg 4.5 has a plurality of slotted holes 4.1 formed therein, which holes extend transverse to the shorter leg 4.4 and are distributed over the entire width of the longer leg 4.5. When the bracket assembly 24 is mounted in the threshold cut-out 7.1, as discussed below, each of the slotted holes 4.1 receives a screw 4.2 as shown in the FIG. 2*a*. A pair of threaded plates 4.3 are attached to an upper surface of the longer leg 4.5, as by welding, adjacent an edge opposite the shorter leg 4.4 and associated ones of the slotted holes 4.1. The door carrier bracket 5 is generally L-shaped with a generally vertically upwardly extending leg 5.4 and a generally horizontally rearwardly extending leg 5.5. A plurality of slotted holes 5.3 are formed in the leg 5.4, which holes extend transverse to the leg 5.5 and are distributed over the entire width of the leg 5.4. The leg 5.4 is attached to the shorter leg 4.4 of the dowel plate 4 by suitable fasteners such as a screw 5.6 which extends through an associated one of the slotted holes 5.3 and threadably engages an associated one of a plurality of threaded apertures formed in the shorter leg 4.4. Thus, the door carrier bracket 5 can be adjusted vertically with respect to the dowel plate 4.

The door carder bracket 5 is longer than the dowel plate 4 and that portion of the bracket 5 projecting horizontally beyond the dowel plate 4 to the left is longer than that portion projecting horizontally beyond the dowel plate to the right. An upwardly facing edge of the leg 5.4, adjacent the dowel plate 4, has a door carrier cut-out 5.2 formed therein which is about one centimeter deep. The cut-out 5.2 has a generally horizontally extending bottom wall of a length "b" and generally vertically extending end walls. As shown in the FIG. 2*a*, an edge of the leg 5.5 opposite the leg 5.4 has a pair of semicircular notches 5.1 formed therein. The spacing between the centers of the notches 5.1 corresponds to the length "b" of the door carrier cut-out 5.2 and the centers of the notches 5.1 are aligned with the end walls of the cut-out 5.2.

The FIG. 2*b* shows an enlarged detail of one of the notches 5.1 and its orientation to a plumb line 6. The elevator shaft 1 is shown in the FIG. 4*a* as having a plurality of the shaft door openings 7, for example four, each of which is closed by one of the fixed barriers 3. The shaft 1 is closed at an upper end by a shaft ceiling 2 and a pair of the plumb lines 6, only one of which can be seen, are attached to the ceiling 2 and extend vertically down the shaft I past all of the openings 7. Attached to a lower end of each of the plumb lines 6 is a plumb line weight 6.1. As shown in the FIGS. 4*a* and 4*b*, each of the lines 6 is held at rest in the plumb position by a respective pin 6.2 around which the line 6 is looped once, the pins 6.2 being mounted on the lowermost one of the door carrier brackets 5.

In the FIG. 5*a*, the shaft door opening 7 is shown with the fixed barrier 3 removed. The bracket assembly 24 is attached to the floor 7.2 at the threshold cut-out 7.1 by any suitable means such as fasteners (not shown) extending through the slotted holes 4.1 in the longer leg 4.5 of the dowel plate 4. The fixed barrier 3 is replaced by a movable barrier 10 pivotally mounted in the threshold cut-out 7.1 for movement towards and away from the elevator shaft 1. Furthermore, one of a pair of metal fastening plates 8 is mounted by suitable means such as fasteners 8.1 at each side of the shall door opening 7 at a spacing "a" from the facing surface of the leg 5.4 of the door carrier bracket 5. Each of the fastening plates 8 includes a generally U-shaped locking bar pocket 9 at the upper end thereof. As shown in the FIG. 5*b*, the locking bar pocket 9 can be formed from a piece of U-iron welded on at the upper end of and abutting a bent-over vertically extending edge of the fastening plate 8. The locking bar pocket 9 has a threaded bore 9.1 formed therein approximately in the center of its rear wall. The fastening plate 8 has a plurality of fastening holes 20, only one of which is shown, located at regular vertical spacings along a longitudinal vertical centerline 20.1 of the plate 8 for receiving the fasteners 8.1. To the right of the centerline 20.1, a plurality of generally U-shaped openings 19.1, only one of which is shown, are formed at regular vertical spacings. In the center of the opening 19.1, there is formed a tongue 19 which extends toward the floor side of the opening 7. The base of the tongue 19 is spaced a distance "c" from the vertical centerline 20.1 of the fastening holes 20.

Figure 6A:
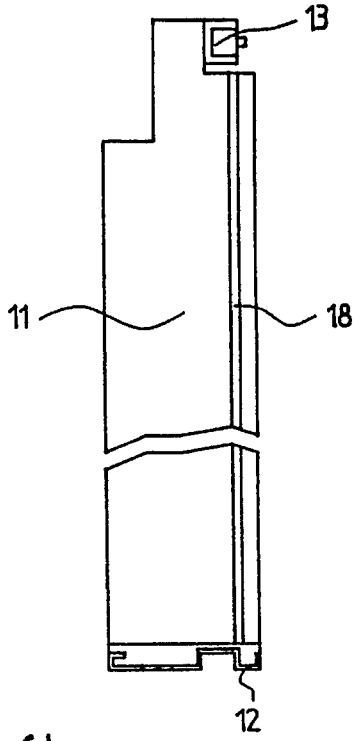
FIG. 6*a* a side elevation view of an elevator shaft door assembly in accordance with the present invention.
Figure 6B:
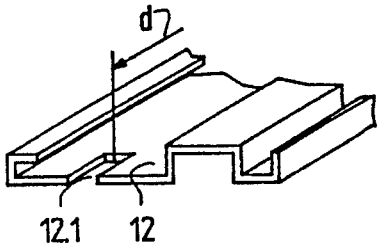
FIG. 6*b* is an enlarged fragmentary perspective view of a portion of the threshold carrier plate shown the FIG. 6*a;*
Figure 7:
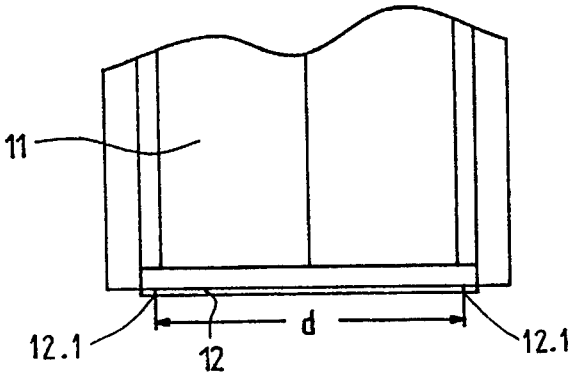
FIG. 7 is a fragmentary front elevation view of a lower portion of the shaft door assembly shown in the FIG. 6*a;*

There is shown in the FIG. 6*a* a side elevation view of a completely pre-assembled shaft door assembly 11 with a pair of locking bar mechanisms 13 mounted laterally at the top thereof, a threshold carrier plate 12 projecting at the underside thereof and a covering bracket 18 fastened on each side thereof. The threshold carrier plate 12 can be formed from sheet metal with a profile as illustrated in the FIG. 6*b*. A generally square recess 12.1 is formed in the wider flat portion somewhat to the left of the center on both end faces. A distance "d" between the inward edges of the recesses 12.1, shown in the FIGS. 6*b* and 7, is approximately one millimeter less than the length "b" of the door carrier cut-out 5.2 of the door carrier bracket 5. The extent of the projection of the threshold carrier plate 12 below the shaft door assembly 11 corresponds to the depth of the cut-out 5.2 and the width of each recess 12.1 is approximately one half millimeter greater than the thickness of the vertical leg 5.4 of the door carrier bracket 5.

Figure 6C:
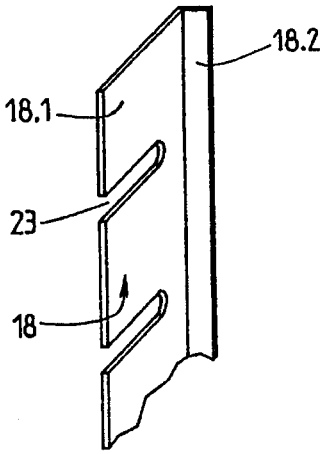
FIG. 6*c* is an enlarged fragmentary perspective view of a portion of the covering bracket shown in the FIG. 6*a;*

The covering bracket 18 is illustrated in the FIG. 6*c* as generally L-shaped with a longer leg 18.1 having a plurality of vertically spaced, horizontally extending slots 23 formed therein. When the bracket 8 is mounted on the door assembly 11 in the door opening 7, as shown in the FIG. 8, the longer leg 18.1 extends generally parallel to the front surface of the door assembly 11 and a shorter leg 18.2 is bent over at a right angle to extend generally parallel to the facing surface of the fastening plate 8.

Figure 8:
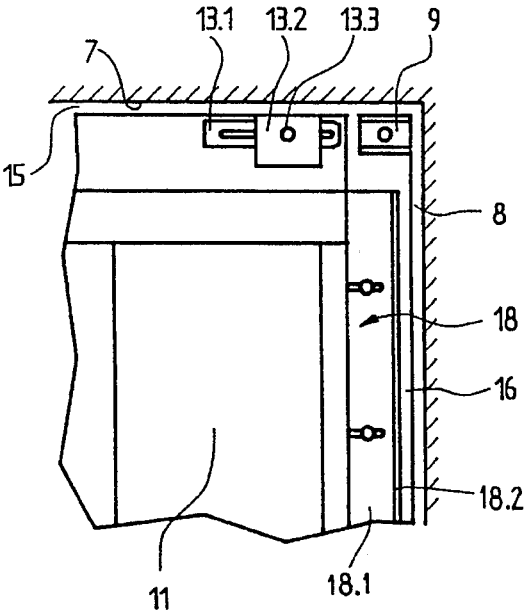
Figure 9:
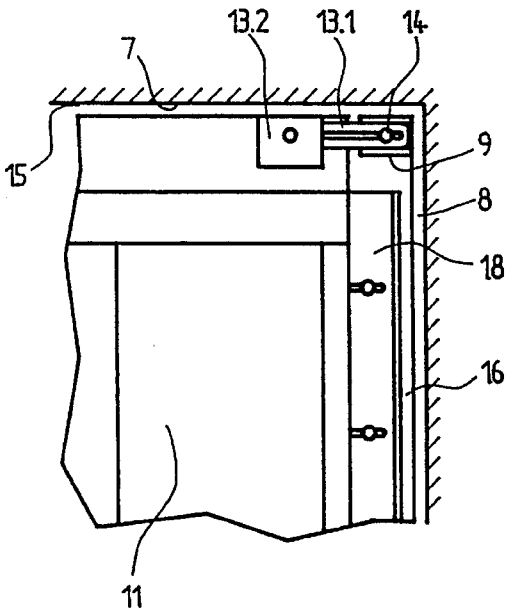
FIG. 9 is a view similar to the FIG. 8 showing the shaft door assembly locked in the shaft door opening.

The FIGS. 8 and 9 show the components and function of the locking bar mechanism 13. A locking bar 13.1 is displaceable horizontally in a locking bar slide 13.2, a pair of which are attached at the upper lateral corners of the shaft door assembly 11. The locking bar slide 13.2 can be a U-iron welded on at the free ends of the legs and having a tightening screw 13.3 threadably engaging a central portion thereof. As shown in the FIG. 8, the locking bar 13.1 is retracted in the locking bar slide 13.2 during the installation of the door assembly 11 in the door opening 7. In the FIG. 9, the locking bar 13.1 is pushed into the locking bar pocket 9 on the fastening plate 8 and fixed by a tightening screw 14 in the threaded bore 9.1 (FIG. 5*b*). An horizontally extending air gap 15 is present between the top of the door assembly 11 and the top of the door opening 7 while a vertically extending air gap 16 is present between each side of the door assembly 11 and the adjacent fastening plates 8.

Figure 4B:
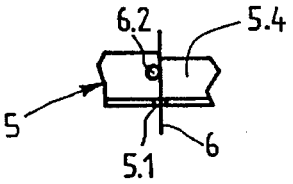

The method of installation according to the present invention includes attaching two plumb lines 6 with the plumb weights 6.1 to the shaft ceiling 2 at a spacing "b" each from the other and extending the lines 6 down the elevator shaft 1 to the lowermost floor as illustrated in the FIG. 4*a*. Then, a bracket assembly 24 including the dowel plate 4 with the attached door carrier bracket 5 is oriented in the threshold cut-out 7.1 of the lowermost floor so that the plumb lines 6, as illustrated in the Fig. 2*b*, are positioned in the center of the corresponding one of the notches 5.1. In this position, hole locations are scribed in the horizontal surface of the cut-out 7.1 through the slotted holes 4.1, these holes are bored and the dowel plate 4 is held in the cut-out 7.1 by the screws 4.2 shown in the FIG. 2*a*. Subsequently, the door carrier bracket 5 is oriented to the correct height and fastened by the screws 5.6, and the bracket assembly 24 is moved into the correct horizontal position and fastened definitively by the screws 4.2. Finally, the pin 6.2 is inserted into the door carrier bracket 5 and the plumb line 6 is looped around the pin 6.2 so that the plumb line 6 remains at rest for the subsequent assembly operations. After all the other floors have been equipped with the assembly bracket 24 in the same manner, the plumb lines 6 can be removed.

All of the shaft door openings 7 are still secured with the fixed barriers 3 against persons falling into the elevator shaft 1. Now, the pivotable barrier 10 is mounted on the dowel plate 4 utilizing the threaded plates 4.3, whereupon the barrier 3 can be removed. Thus, the shaft door opening 7 is secured without interruption against the falling-in of persons. The pivotable barrier 10 can be of the type shown in the U.S. Pat. No. 5,241,789. The barrier 10 is pivoted into the position shown in the FIG. 5*a* so that both sides of the shaft door opening 7 are accessible for the mounting of the metal fastening plates 8. These plates 8 are fastened at the sides of the opening 7 by screws 21 (FIG. 13) so that the locking bar pockets 9 are exactly at the same height and at the spacing "a" from the leg 5.4 of the door carder bracket 5.

Figure 10:
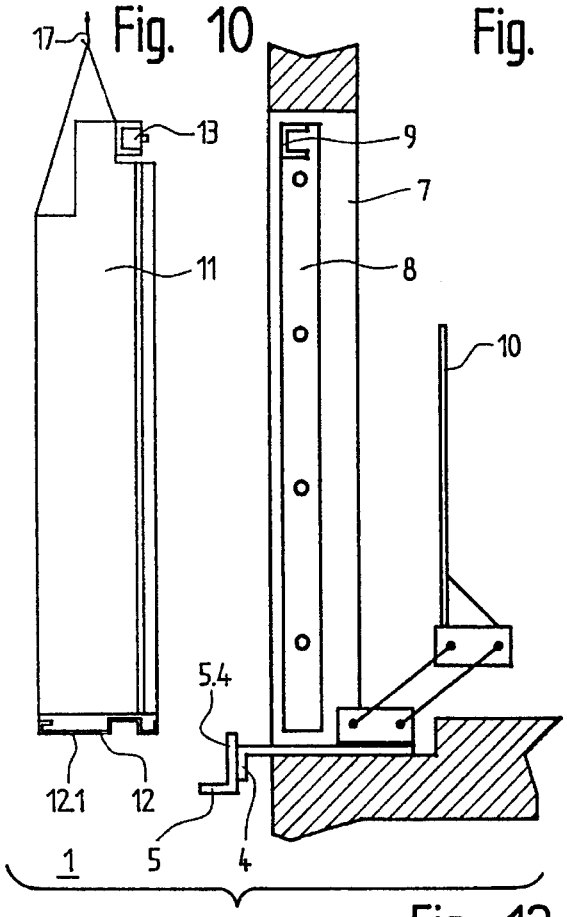
FIG. 10 is view similar to the FIG. 5*a* showing the shaft door assembly suspended in the elevator shaft adjacent the shaft door opening.
Figure 11:
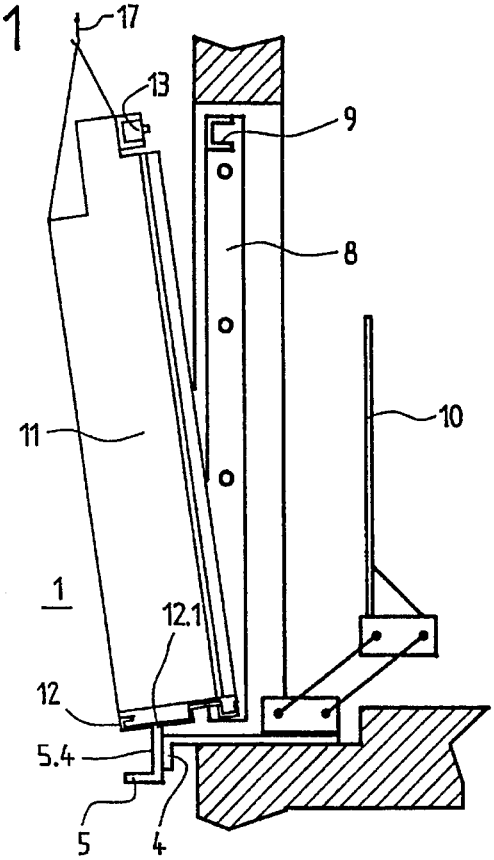
FIG. 11 is a view similar to the FIG. 10 showing the lower portion of the shaft door assembly mounted in the shaft door opening.
Figure 12:
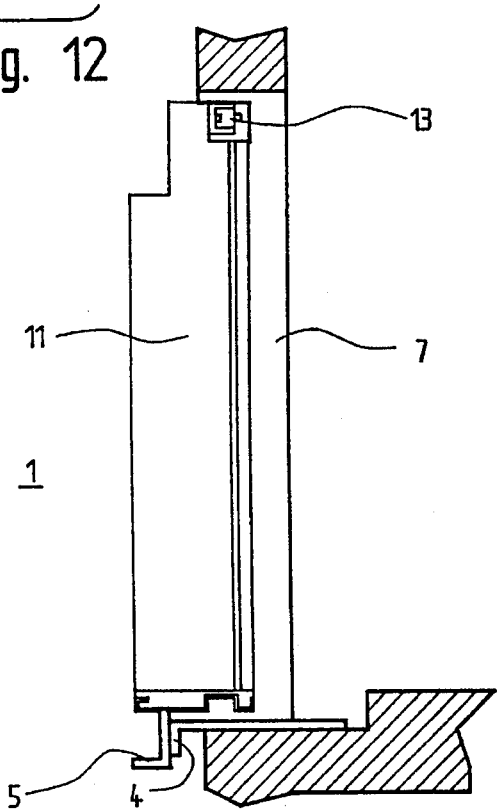
FIG. 12 is a similar to the FIG. 11 showing the shaft door assembly pivoted into the shaft door opening.

As shown in the FIG. 10, the barrier 10 is pivoted towards the floor 7.2 and the thus prepared shaft door opening 7 is now ready for the installation of the shaft door assembly 11. The preassembled shaft door assembly 11 is lifted in the shaft 1 by a hoist 17 to the height of the corresponding shaft door opening 7. Then, as shown in the FIG. 11, the assembly 11 is set down on the door carrier bracket 5 so that the threshold carrier plate 12 detents the recesses 12.1 in the door carrier cut-out 5.2 of the leg 5.4 of the door carrier bracket 5. After the detenting, the lower part of the shaft door assembly 11 is fixed in the horizontal plane. Thereupon, the shaft door assembly 11 is pivoted into a vertical position in the shaft door opening 7, as shown in the FIG. 12, and the locking bars 13.1 at both sides are pushed into the corresponding locking bar pockets 9 and made fast by the screws 14 and the screws 13.3 as shown in the FIGS. 8 and 9. The hoist 17 can now be removed since the shaft door assembly 11 is fastened sufficiently in the shaft door opening 7 to complete the method of installation.

Figure 13:
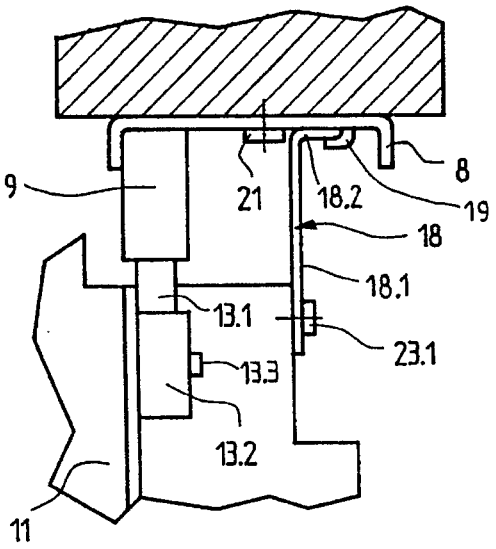
FIG. 13 is an enlarged fragmentary top plan view of an upper portion of the shaft door assembly and shaft door opening shown in the FIG. 12.

As shown in the FIG. 13, the covering brackets 18 are attached to the front surface of the shaft door assembly 11 by screws 23.1 which engage respective ones of the slots 23. The screws 23.1 are loosened to permit movement of the brackets 18 from the door assembly insertion position, shown in the FIGS. 8 and 9, to the installed position, shown in the FIG. 13. The brackets 18 are moved outwardly until the shorter leg 18.2 abuts the surface of the adjacent fastening plate 8, whereby the vertically extending air gaps 16 are closed. In order to fix the covering brackets 18 in this position, the tongues 19 of the fastening plate 8 are bent outwardly by means of a screwdriver to permit passage of the leg 18.2, and then laid over by means of hammer and punch to engage and retain the shorter leg 18.2 of the covering bracket 18. Since the rear edge of the covering bracket 18 abuts the screws 21 and the front edge is held fast by the tongues 19, the bracket 18 is fixed unambiguously in this position. The screws 23.1 are then drawn tight whereby the actual fastening of the shaft door assembly 11 in the shaft door opening 7 is completed.

The fasteners and associated parts now still visible at the side and the top of the opening 7, and the horizontal air gap 15 now still present at the top of the assembly 11 are subsequently covered by appropriate, not illustrated, trim and metal cladding plates by screwing, gluing and jointing techniques. As seen from the floor side, the elevator door is now installed and the corresponding floor can now be completed independently of the further elevator assembly, and can be furnished and occupied. According to the method of installation, individual floors can be equipped with the pre-assembled shaft door assembly 11 when required. Advantageously, at least the assembly bracket 24 is however pre-assembled at all floors of a building in order to undertake the orienting work only once. The covering trim and plates can be of such a nature that they fulfill different requirements in different executions, for example, in respect of internal architecture, fire protection and noise insulation.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for installing a pre-assembled elevator shaft door in an elevator shaft door opening comprising the steps of:

a. orienting a bracket assembly having a predetermined length door carrier cut-out formed therein at a predetermined position in a threshold recess of an elevator shaft door opening of an elevator shaft and fixing said bracket assembly to the threshold recess;

b. orienting said door carrier cut-out to a desired height with respect to the threshold recess and fixing said door carrier cut-out at said desired height;

c. mounting generally vertically extending fastening plates on both sides of the shaft door opening at a first predetermined distance from said door carrier cut-out;

d. lifting a pre-assembled shaft door assembly up an elevator shaft to the shaft door opening and setting a lower end of the shaft door assembly down on said bracket assembly, the lower end of the shaft door assembly having a threshold carrier plate attached thereto, said threshold carder plate having a pair of recesses formed therein spaced apart a second predetermined distance, said second predetermined distance being less than said first predetermined distance and said recesses detenting in said door carrier cut-out;

e. pivoting the shaft door assembly on said bracket assembly into a generally vertical position in the shaft door opening;

f. extending laterally locking bars mounted on the shaft door assembly into locking bar pockets mounted on said fastening plates and fixing said locking bars; and g. bending outwardly tongues formed in said fastening plates, drawing laterally covering brackets mounted on the shaft door assembly into abutment with said fastening plates, bending said tongues over said covering brackets and fixing said covering brackets to the shaft door assembly.

2. The method according to claim 1 wherein said step a. includes attaching a pair of plumb lines to a ceiling of the elevator shaft spaced apart by said predetermined length and aligning each of a pair of notches formed in said bracket assembly with a respective one of said plumb lines.

3. The method according to claim 1 wherein said step a. includes attaching a pair of plumb lines to a ceiling of the elevator shaft spaced apart by said predetermined length, orienting one of said bracket assemblies at each of a plurality of floors associated with the elevator shaft with said plumb lines and removing said plumb lines from the elevator shaft.

4. An apparatus for installing an elevator door assembly in a door opening in an elevator shaft comprising:

a bracket assembly having means for mounting in a generally horizontally extending threshold cut-out at a shaft door opening in an elevator shaft, a predetermined length door carrier cut-out formed therein, means for selectively orienting said bracket assembly horizontally in the threshold cut-out and means for selectively orienting said door carrier cut-out vertically with respect to the threshold cut-out;

a threshold carrier plate adapted to be attached to a lower end of a shaft door assembly and having a pair of recesses formed therein, said recesses being spaced apart a predetermined distance, said predetermined distance being less than said predetermined length and said recesses detenting in said door carrier cut-out when said threshold carrier plate and the attached shaft door assembly are mounted on said bracket assembly;

at least one locking bar mechanism adapted to be mounted on the shaft door assembly and being selectively extendable;

at least one fastening plate adapted to be mounted on a side of the shaft door opening and having a locking bar pocket for receiving said locking bar mechanism when the shaft door assembly is mounted on said bracket assembly in the shaft door opening; and at least one selectively displaceable covering bracket adapted to be mounted on the shaft door assembly for abutting said fastening plate when said fastening plate and the shaft door assembly are mounted in the shaft door opening.

5. The apparatus according to claim 4 wherein said means for mounting said bracket assembly includes at least one hole formed therein and at least one screw extending through said hole into threaded engagement with the threshold cut-out.

6. The apparatus according to claim 4 wherein said bracket assembly includes a dowel plate and said means for selectively orienting said bracket assembly horizontally includes at least one slotted hole formed in said dowel plate and at least one screw extending through said slotted hole into threaded engagement with the threshold cut-out.

7. The apparatus according to claim 6 wherein said bracket assembly includes a door carrier bracket and said means for selectively orienting said door carrier bracket vertically includes at least one slotted hole formed in said door carrier bracket and at least one screw extending through said slotted hole into threaded engagement with said dowel plate.

8. The apparatus according to claim 4 wherein said predetermined distance between said recesses is approximately one millimeter less than said predetermined length of said door carrier cut-out.

9. The apparatus according to claim 4 wherein said door carrier cut-out has a depth corresponding to a projection of said threshold carrier plate below the shaft door assembly.

10. The apparatus according to claim 9 wherein said locking bar mechanism includes a screw threadably engaging said locking bar slide for fixing said locking bar.

11. The apparatus according to claim 9 wherein said locking bar pocket includes a screw threadably engaging said locking bar pocket for fixing said locking bar.

12. The apparatus according to claim 4 wherein said bracket assembly has a pair of semicircular notches formed therein spaced apart by said predetermined length for orientation to plumb lines in the elevator shaft.

13. The apparatus according to claim 4 wherein said locking bar mechanism includes a locking bar movable in a locking bar slide, said locking bars being extendable into said locking bar pocket.

14. The apparatus according to claim 1 wherein said fastening plate has at least one tongue formed therein for retaining said covering bracket.

15. The apparatus according to claim 1 wherein said covering bracket has a plurality of generally horizontally extending slots formed therein and including screws extending through said slots and threadably engaging the shaft door assembly.

16. An apparatus for installing an elevator door assembly in a door opening in an elevator shaft comprising:

a bracket assembly for mounting in a generally horizontally extending threshold cut-out at an elevator shaft door opening, said bracket assembly having a dowel plate attached to a door carrier bracket, said door carrier bracket having a predetermined length door carrier cut-out formed therein, said dowel plate having means for selectively orienting said bracket assembly horizontally in the threshold cut-out and said bracket assembly having means for selectively orienting said door carrier cut-out vertically with respect to the threshold cut-out;

a threshold carrier plate adapted to be attached to an elevator shaft door assembly and having a pair of recesses formed therein, said recesses being spaced apart a predetermined distance, said predetermined distance being less than said predetermined length and said recesses detenting in said door carrier cut-out:

a pair of locking bar mechanisms adapted to be mounted at upper corners of the shaft door assembly and each being selectively extendable;

a pair of fastening plates adapted to be mounted at opposite sides of the shaft door opening and each having a locking bar pocket for receiving an associated one of said locking bar mechanisms; and a pair of selectively displaceable covering brackets adapted to be mounted on the shaft door assembly at opposite sides thereof for abutting said fastening plates and covering air gaps between the shaft door assembly and the sides of the shaft door opening.

* * * * *